US006372086B1

(12) United States Patent
Sieron et al.

(10) Patent No.: US 6,372,086 B1
(45) Date of Patent: Apr. 16, 2002

(54) PULPER AND COUNTERCURRENT WASHER SUGAR CANE EXTRACTION

(75) Inventors: Michael A. Sieron, Dayton, OH (US); Kirk A. King, San Diego, CA (US); Steven T. Haywood, Memphis, TN (US)

(73) Assignee: Kadant Black Clawson Inc., Middletown, OH (US)

( * ) Notice: Subject to any disclaimer, the term of this patent is extended or adjusted under 35 U.S.C. 154(b) by 0 days.

(21) Appl. No.: 09/686,393

(22) Filed: Oct. 9, 2000

Related U.S. Application Data

(63) Continuation-in-part of application No. PCT/US99/18652, filed on Aug. 17, 1999.
(60) Provisional application No. 60/096,812, filed on Aug. 17, 1998.

(51) Int. Cl.[7] ..... D21H 11/12
(52) U.S. Cl. ..... 162/96; 162/91; 162/56; 162/57; 162/60
(58) Field of Search ..... 162/60, 55, 56, 162/57, 58, 91, 96

(56) References Cited

U.S. PATENT DOCUMENTS

| | | | | |
|---|---|---|---|---|
| 4,154,644 A | | 5/1979 | Ericsson | 162/60 |
| 4,237,582 A | * | 12/1980 | Villavicencio | 19/7 |
| 4,260,452 A | | 4/1981 | Krüger et al. | 162/23 |
| 4,725,007 A | | 2/1988 | Chupka | 241/46.02 |
| 5,367,894 A | | 11/1994 | Parks et al. | 68/22 |

FOREIGN PATENT DOCUMENTS

WO 0009799 2/2000

OTHER PUBLICATIONS

Atchison, Ph.D., J.E., "Factors Influencing the Selection of Processes and Choice of Equipment for Bagasse Pulp Manufacture" Paper presently understood to have been presented at the Latin American Meeting of Experts on the Pulp and Paper Industry, Buenos Aires, Argentina, Oct. 18–Nov. 2, 1954.

Atchinson, Ph.D., J.E., "Planning, Financing and Building a Bagasse Pulp and Paper Mill" Talk presently understood to have been presented at Bagasse Industrial Conference, Franklin, Louisiana, Mar. 27, 1959.

Martinez, S.E., "Most Modern Bagasse Pulp and Paper Mill" reprinted from *Paper Trade Journal,* Apr. 17, 1961 (4 pages).

(List continued on next page.)

*Primary Examiner*—Dean T. Nguyen
(74) *Attorney, Agent, or Firm*—Biebel & French

(57) ABSTRACT

Processes are disclosed for extracting sugar rich liquor from sugar cane. The sugar cane is first treated by pulping it in two tub type pulpers having a rotating impeller. The contents of the first pulper are extracted through the bedplate of the extractor and are forwarded onto the second pulper. The contents of the second pulper are extracted through the bedplate of the extractor and are forwarded to form a mat on a moving belt countercurrent extractor of the type having a foraminous belt. Negative pressure is applied below the belt to assist the extraction of a sugar rich liquid component through the belt. The material passes through several separation zones as it travels on the belt with liquid applied to the mat from a region above the belt. The extracted liquid component is collected for further processing.

7 Claims, 4 Drawing Sheets

OTHER PUBLICATIONS

Atchison, Ph.D., J.E., et al., "The Use of Sugar Cane Bagasse As Raw Material for Producing Various Grades of Paper" presently understood to have been presented at the First Annual Conference of the "Asociacion Mexicana de Tecnicos de las Industrias de la Celulosa y del Papel," Mexico City, Mexico, May 25–27, 1961.

Martinez, S.E., "Sugar Cane Bagasse Shifts From a Waste Fuel to Basic Raw Materials," reprinted from *Power,* Jan. 1964 (4 pages).

Dyck, A.W.J., "Olin's $50–Million Expansion An Unqualified Success," reprinted from *American Paper Industry,* Sep. 1966 (12 pages).

"Bagasse Pulp Plant" published at http://www.papeleranacional.com/bagazo_e.htm Jun. 8, 2000 (2 pages).

Black Clawson CHEMI–WASHER® Horizontal Belt Design Washer brochure (date unknown).

* cited by examiner

PULPER AND COUNTERCURRENT WASHER SUGAR CANE EXTRACTION

RELATED APPLICATIONS

This application is a continuation-in-part of International application PCT/US99/18652 filed Aug. 17, 1999, which International PCT Application claims the benefit of U.S. provisional application Ser. No. 60/096,812 filed Aug. 17, 1998.

FIELD OF THE INVENTION

This invention relates to processes and apparatus for sugar extraction from cane, and more particularly to an efficient diffusion extraction process.

BACKGROUND OF THE INVENTION

In present day sugar diffusion processes, the entire cane is usually subjected first to a cutting or shredding process by which the cane sugar cells in the pith and rind are ruptured open, or at least in which a substantial number of such cells are ruptured. The finely divided cane is then subjected to diffusion, where the refined pulp material is applied to one of a number of different diffusers at a relatively high consistency, such as about 8%–12% solids or higher. Heated water or steam is applied and juices and liquids are extracted in a tank or on a conveyor belt. In some instances, the extracted material flows in a countercurrent manner against the direction of travel of the refined cane material. Extraction in such diffusers is by gravity combined, in some cases, with mechanical pressing.

The term "diffusion" has been applied to various apparatus and methods by which a shredded, sliced, ground or refined cane or, in some instances, bagasse, is subjected to extraction by contact with heated fluid. In a true diffusion process, the plant cell is not ruptured and advantage is taken of the property of the dissolved crystals passing through the cell wall when water or other solution is more dilute than that in the cell. Following such diffusion, all solutions in contact with cells tend to achieve equal concentrations with the fluid in the cell.

Current refining practice has been to treat the cane in such a manner that, to a large extent, the cells are ruptured, and the sugar removal more nearly resembles a washing process called lixiviation. Apparently, both diffusion and lixiviation occur at the same time, but the term "diffusion" has become generically applied to such extraction processes and equipment quite apart from the fact that limited actual diffusion may be taking place.

While a great deal of attention has been paid to the construction and operation of diffusion equipment, this equipment still operates principally upon through-flow arrangements which depend upon gravitational drainage, at relatively high consistency, and therefore the efficiency and production rates are accordingly limited.

Although the diffusion process has been used, it is not believed to be practiced currently to a considerable extent, having been replaced in deference to the "tandem" process of running the cane between sets of high pressure rolls, such as six such sets, to crush the cane under the extreme pressure of the rolls, which may exert forces of 1,000 to 4,000 pounds per square inch. The roller crushers or "tandems" as they are known in the trade require a substantial power to drive, typically with the equivalent of approximately 1,500 horsepower each, and are known to present high maintenance problems.

SUMMARY OF THE INVENTION

Substantially improved production rates and efficiency can be obtained by adapting certain processing equipment that has already been developed and used in the preparation of papermakers' pulp. The cane is "refined" or macerated in a tub type pulper known in the industry as a hydrapulper. In a hydrapulper, material to be pulped is placed in a tub in which a specially designed impeller or rotor is mounted at the tub bottom above a perforated bedplate. Heated dilution water is added as necessary to achieve a desired consistency, and the pulped material is extracted through the bedplate after a sufficient period of residence time has elapsed. The pulper, or pulpers may be made according to U.S. Pat. Nos. 4,725,007 and 4,109,872, incorporated herein by reference. The impeller or rotor is preferably a "MidCon" rotor of Thermo Black Clawson, Inc. according to U.S. Pat. No. 4,725,007 incorporated herein by reference. The hydrapulper is highly efficient in reducing the fibrous content of the cane and breaking open the cell structure, permitting release of the sugar juices into the slurry.

The pulping takes place at relatively high consistencies (approximately 8%–10%) and uses recycled filtrate from the countercurrent washer's formation and first stage wash zones. The pulping will continue until a major portion of the sugar content is dissolved in the liquid content, such as up to 30 minutes or more to each pulper preferably at an elevated temperature, such as about 50–75° C., so that about 70%–99% and preferably up to 98% or more of the sugar content has been extracted into the liquid phase.

When the pulping is completed, the slurry is extracted through the perforated pulper bedplate of the final pulping stage diluted to a lower consistency, and it is applied through a headbox onto the top side of the continuously moving belt of a flat bed fordrinier type countercurrent displacement type extractor. Such an extractor employs an endless foraminous belt, (often called a "wire"), a headbox which delivers the suspension to the on-running or upstream end of the horizontally traveling upper run of the belt while at the relatively low consistency of about 2%–4% solids at an elevated temperature. The pulped material is thus deposited on the upstream end of the run of the belt where a mat is formed as the sugar-rich liquid drains through the belt and is withdrawn for further processing.

The belt runs downstream from the formation zone and is divided into a series of displacement zones to which liquid is supplied as from showers from above for drainage through the mat and through the belt and into receptacles below the belt. Fresh washing liquid or heated water is applied at the last of these zones at the downstream end of the belt run, and the liquid drained from the last zone is collected and delivered to the zone immediately upstream from the last zone, and these steps are repeated for each of the other zones to affect countercurrent extraction from the pulp.

The entire apparatus is enclosed in a hood. A series of receptacles are positioned below the upper run of the belt in sealed relation with the hood. Suction or vacuum is applied to these receptacles. The vacuum from below and the air pressure above augment the action of gravity in forcing the liquor to flow through the pulped mass on the wire. A particular feature of the apparatus is that of recycling the gases and vapors drawn through the belt back to the hood to increase the pressure differential across the belt. The above-described apparatus is more fully described in the patents of Ericsson, U.S. Pat. No. 4,154,644, issued May 15, 1979 and Parks et al., U.S. Pat. No. 5,367,894, issued Nov. 29, 1994, which patents are incorporated herein by reference.

Preferably, immediately downstream of the final extraction stage, the pulp mass is subjected to pressure extraction by pressing one or more rolls above the belt against rolls within the belt loop, such as shown in U.S. Pat. No. 5,367,894. This provides mechanical extraction of liquid from the mat on the belt so that the pulp or bagasse remainder exits the apparatus having given up most of its liquid content, to the range of about 40% consistency. Thus, in the pressing stage, more than 70% of the liquid remaining in the pulp is expressed therefrom and captured. If desired, lime or other agents may be added to the pulp and liquid within the countercurrent extraction equipment.

A principal advantage of the use of the combination of the hydrapulper and countercurrent extraction washer resides in the fact that the hydrapulper releases 70% or more of the sugar content of the cane into the liquid content within the hydrapulper. When this is extracted through the hydrapulper bedplate with the pulped cane and applied to the headbox of the belt type extractor, the suspension is at about 2%–4% solids. On the belt, it increases from 2%–4% up to about 15% solids before final pressing. This extraction is of high efficiency by reason of the fact that it is accomplished with a pressure differential including a negative pressure head or vacuum below the belt. This translates into a high degree of extraction coupled with a high processing rate compared to that of diffusion extractors dependent upon gravity alone for separation. Since the pulp slurry applied to the belt is at low consistency and in a thin layer (2" or less in thickness), the sugar remaining in the mat after draining is much less than in conventional extraction systems where the consistency is 12%–15% and the fiber depth is measured in feet. Accordingly, there remains much less sugar to be extracted at this point, as compared to conventional systems.

A further aspect of the invention resides in the employment of a pair of pulpers arranged in tandem so that they can operate on a continuous basis as distinguished from a batch basis. Where a single pulper is used, or a pair of pulpers in parallel relation, it is necessary to operate essentially each of the pulpers for a sufficient period of time, preferably alternatively, in order to provide the necessary residence time of the chopped cane in the pulper. When pulpers are arranged in tandem, each pulper may be optimized for pulping and breaking down the cane, by controlling the size of the openings in the bedplates (extraction plates). Thus, a first pulper can receive the cane in larger pieces, and it can be optimized by using an extraction plate with relatively larger openings, while a second pulper, which receives the high consistency pulp form the first pulper, can have an extraction plate with substantially smaller openings.

In either case of the pulpers operating in tandem or by the batch, it is preferred to chop the cane initially into relatively small pieces, such as by running the cane through a conventional wood yard type log chipper, such as is used for chipping limbs from trees that have been removed by road workers, power line and telephone workers, or as used in logging operations for chipping and shredding brush and branches up to 6 to 8 inches in diameter, as an example.

The chipper and pulpers entirely eliminate the first operation in a sugar cane process, namely, the conventional roller milling operation.

The apparatus and process of this invention substantially reduces the energy, i.e., horsepower, that is presently used by the sugar industry to operate the present usual arrangements of tandem presses used to extract sugar from the cane. Since the chippers and pulpers as preferably employed by this invention have few moving parts as compared to typical tandem three roll presses, maintenance problems are reduced.

It is therefore an object of the invention to extract a sugar rich liquor from sugar cane including the steps of pulping the sugar cane in sugar filtrate or water in a tub type pulper with a rotating impeller at an elevated temperature to reduce the cane to a pulp and fracture the cells to release the sugar content into the liquid phase, extracting the contents of the pulper through an extraction bedplate, applying said extracted material to the headbox of a moving belt type displacement extractor and applying said suspension onto a foraminous belt, applying a relatively negative air pressure below said belt (and/or a positive pressure on the belt) to augment the extraction of liquid content from said pulp through the belt, leaving a mat of pulp on the belt at a substantially higher consistency, and subjecting the mat to repeated zones of separation in which liquid is applied to the mat from a region above the mat and extracting liquid at the corresponding zone below the mat.

A further object of the invention includes carrying the mat through a plurality of extraction zones in which the liquid extracted from the last of said zones is applied to preceding zones in a countercurrent manner.

Another object of the present invention is to cut the sugar cane into small pieces and apply the small pieces to a tank type pulper in which a rotor at the bottom of the pulper tank is positioned to run against a perforated bedplate, adding sugar filtrate or water at an elevated temperature to said tank while operating the pulper to achieve a consistency of solid contents to liquid of about 8%–10%, continuing to operate the pulper rotor until at least about 70% or more up to about 98% of the sugar content of the cane is dissolved in the liquid phase, and draining the pulper through the bedplate and separating the liquid phase from the non-liquid phase.

A more particular object is to provide a sugar cane pulping process in which the sugar filtrate or water is added to achieve an elevated pulp temperature. The content of the pulped cane in the pulper tank is diluted to a consistency of about 2%–4% and is applied to the headbox of a moving perforated or wire belt type displacement extractor onto an on-running end of a moving wire, of applying a negative air pressure below the wire to augment the extraction of liquid content through the wire such that the consistency of the mat of pulp formed on the wire increases from about 2%–4% at the on-running end to about 15% at the off-running end, while subjecting the mat to repeated zones of separation in which liquid is applied to the fiber mat from a region above the mat and extracted from extraction zones below the mat. The mat on the wire may then be pressed between rollers at the off-running end of the wire for a final pressure extraction of liquid from the mat leaving a bagasse mat on the wire having a consistency of about 40% to about 50% or higher.

A still further object of the invention is the use of two or more pulpers in tandem, that may be operated on a continuous basis, having progressively smaller extraction plates, for higher efficiency of rupture of the sugar containing cells of the can providing for extraction of the sugar content.

Yet another object of the invention is the provision of a pulping method with displacement extraction, in which the cane is prepared for pulping by chipping in a wood yard type log chipper.

Other objects and advantages of the invention will be apparent from the following description, the accompanying drawings and the appended claims.

BRIEF DESCRIPTION OF THE PREFERRED EMBODIMENTS

Figure 1:
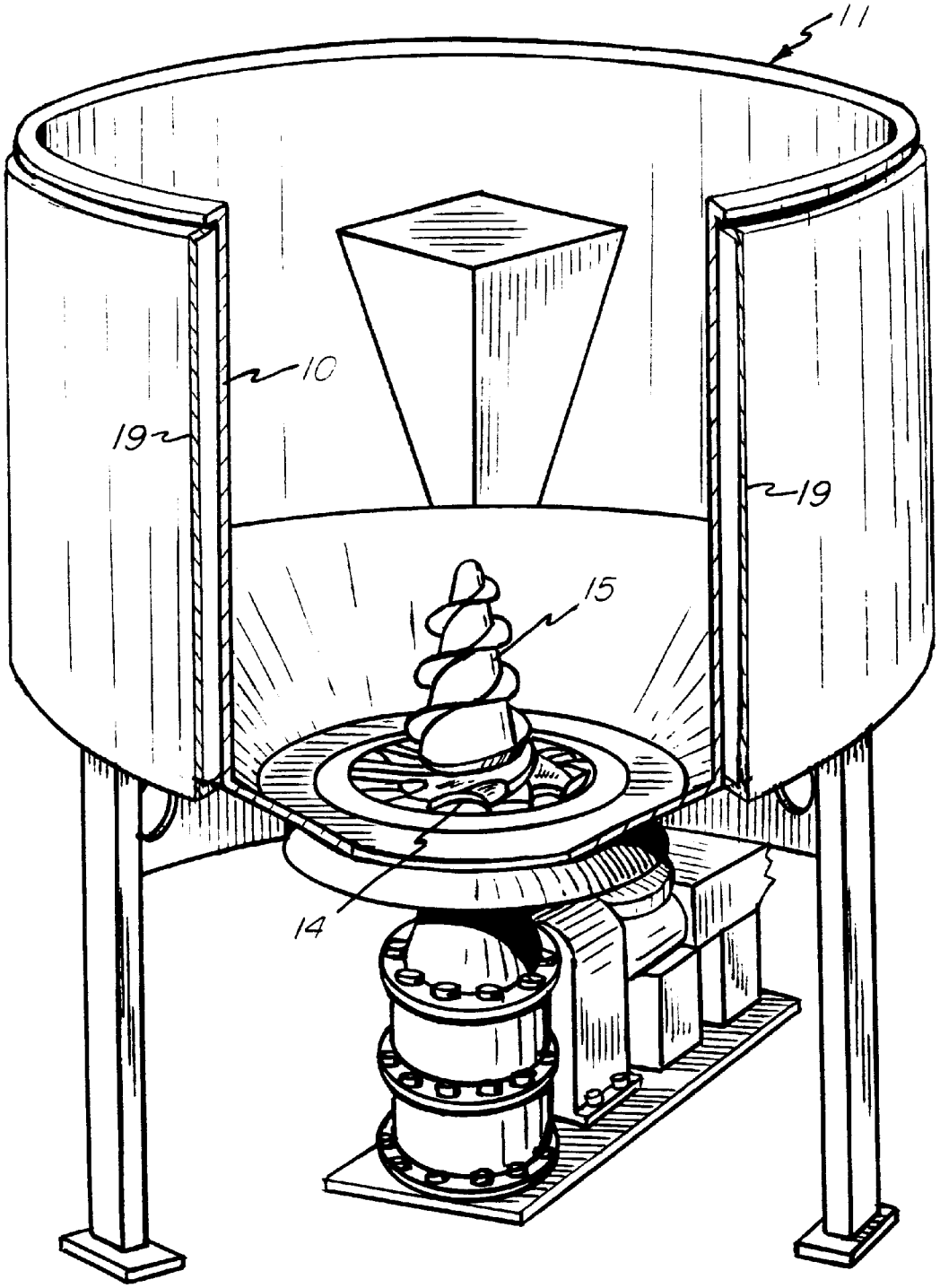
FIG. 1 is a sectionalized and somewhat diagrammatic view of a pulper used in this invention.
Figure 2:
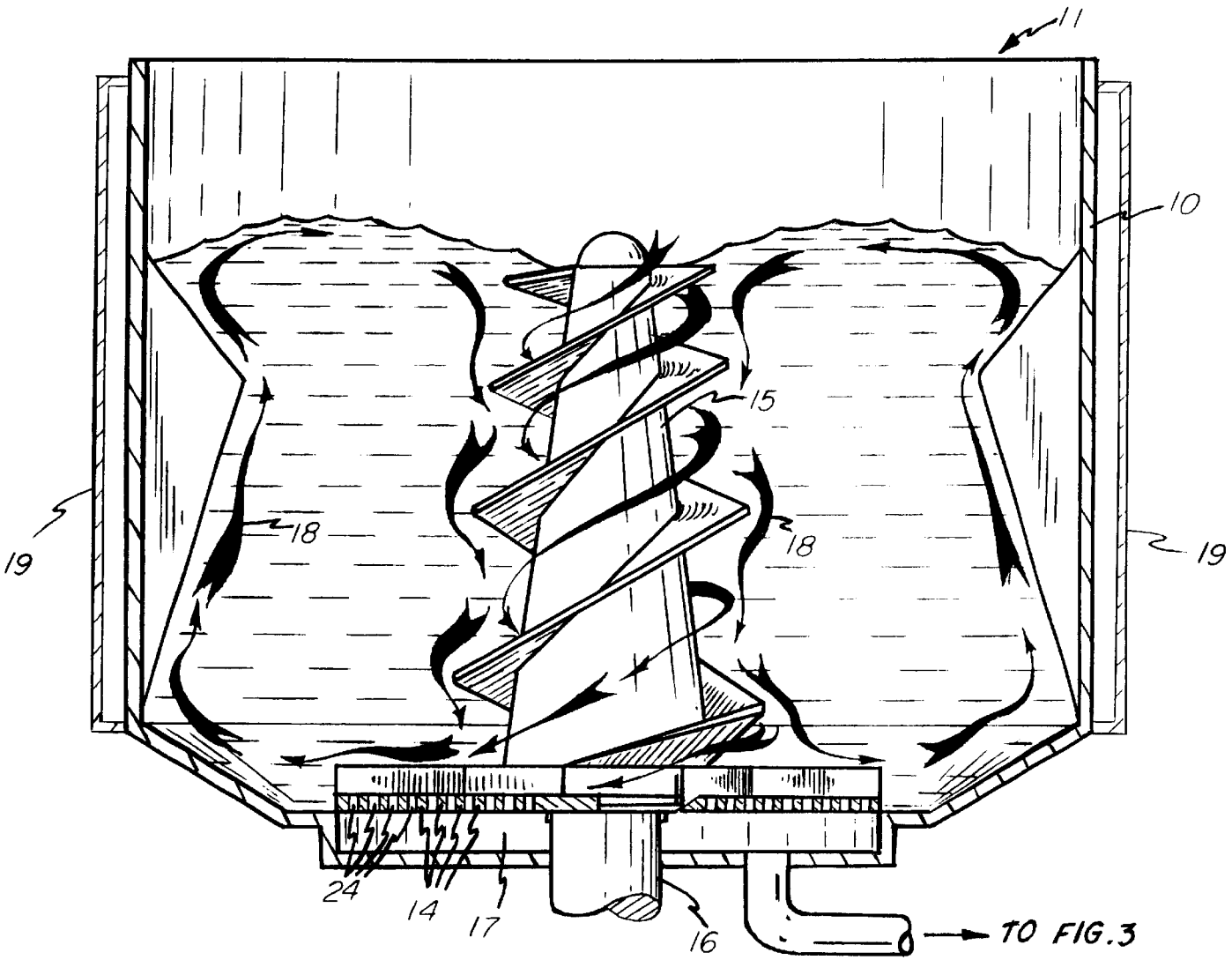
FIG. 2 is an enlarged sectional view of a portion of the pulper tub bottom including a portion of the bedplate of the pulper of FIG. 1.

Referring to the drawings which illustrate preferred apparatus for the practice of the process of this invention, cut cane to be pulped is applied to the interior of the tank or tub 10 of a pulper 11. Preferably, the cut cane has been chipped by applying the stalks to a wood yard or brush type chipper that cuts the cane into smaller pieces than does current shredders. The chipped cane would go directly to a pulper.

As previously noted, the pulper is better known as a hydrapulper and may be constructed in accordance with the teachings of U.S. Pat. No. 4,109,872 of Aug. 29, 1978 and U.S. Pat. No. 4,725,007 of Feb. 16, 1988. The hydrapulper 11 thus includes a tank 10 with a bottom wall 13. The center portion of the bottom wall supports an annular extraction bedplate 14. A "MidCon" rotor or impeller 15 is mounted for rotation on a shaft 16 and positioned immediately above the extraction bedplate 14. An extraction chamber 17 is formed below the bedplate 14. When the impeller is rotated, a circulatory motion is created in the tank 10 as shown by the arrows 18. The operation of the rotor vanes with respect to the bedplate creates a strong defibering action. The tub content is then withdrawn through the outlet 20.

The temperature of the slurry formed in the tank 10 should preferably be maintained in the order of about 50–75° C. or higher, such as by a steam jacket 19 surrounding the pulp tank 10. The pulper is operated to reduce the size particles of the pieces of cane to the point where individual pieces are no longer discernable, and the mass has a smooth and fine characteristic of a slurry of fibers in water. The consistency during pulping may be between about 8%–10% solids-to-liquid. Grab samples can be taken to determine the extent of reduction of the fibers which, in any case, are substantially smaller than the openings 24 in the bedplate 14. If desired, a portion of the material of the slurry in the tank 10 may be extracted while running through the tank outlet 20 and recirculated into the tank to enhance or increase the defibering action of the rotor 15.

The pulping process will continue until at least about 70% and up to about 98% of the sugars have been extracted by diffusion and by mechanical washing into the liquid phase of the slurry. In the typical hydrapulper installation, this may take between about 20 to 40 minutes of operation.

Figure 3:
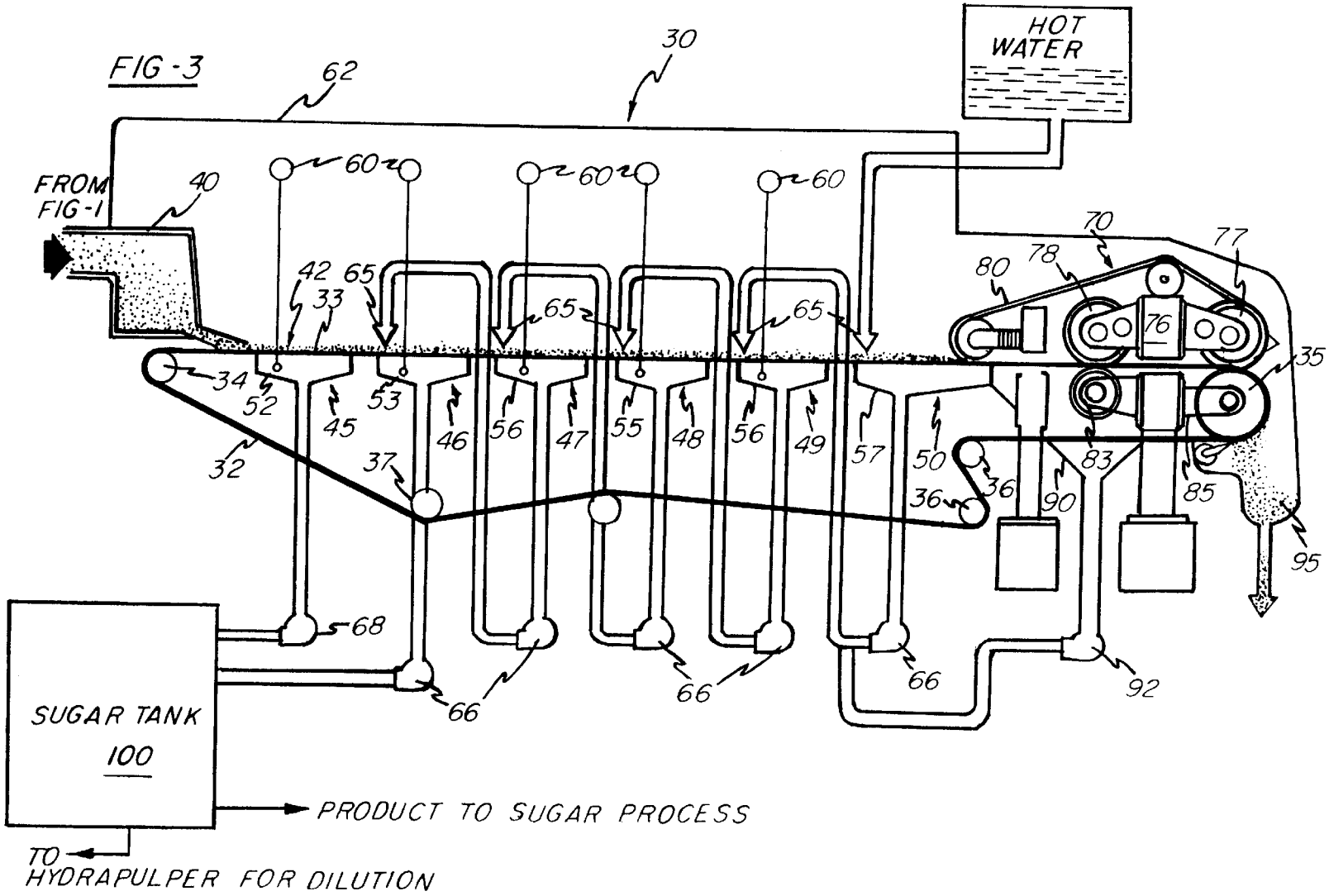
FIG. 3 is a diagrammatic view of the belt-type extractor used in this invention.

At the appropriate time, the slurry within the tank 10 may be withdrawn and applied to the belt-type washer extractor 30 diagrammatically illustrated in FIG. 3. The slurry should be diluted at or beyond the hydrapulper 10 to a relatively lower consistency of between about 2%–4% solid component.

In the belt-type displacement extractor 30, a frame, not illustrated, supports an endless foraminous wire or belt 32 in a closed loop to define a substantially horizontal upper run 33 leading from a breast roll 34 at the upstream end of the upper run 33 and terminating at a couch roll 35 at the off-running or downstream end of the run. The couch roll 35 commonly is the main drive roll for the belt 32, while the return run goes over conventional tensioning rolls 36 and guide rolls 37 to return to the on-running end.

A headbox 40 deposits slurry from the hydrapulper 10 onto the upper surface of the wire 32 to a rather substantial thickness (approximately 2" thick) to form on such upper surface a mat 42 of pulped fibers. This mat passes through an initial extraction zone 45 and then through a series of supplemental extraction zones 46–50.

The extraction zones are defined by a series of vacuum receptacles 52–57 located in general alignment inside the wire loop under the wire 32. A negative pressure is drawn on each of the receptacles by suction fans or blowers diagrammatically shown at 60. The hood 62 encloses all of the zones 45–50 while the fans 60 create a negative pressure in each of the zones immediately below the horizontal run 33 of the wire 32 for enhancing the rate of withdrawal of the liquid phase through the mat 42.

For each of the zones 46–50, there is a shower 65 located in the hood 62 above the wire and above the mat 42 in such a manner that the shower impacts the mat material substantially at the point where the material enters the respective zone. The showers 50 are operated in a countercurrent manner, as more particularly described in the previously referenced U.S. Pat. No. 5,367,894 in such a manner that the shower associated with the zone 50 will typically apply a hot water film, while the preceding showers will, in turn, be connected to liquid material drawn through the associated extraction pans 53–57. The flows from the pans associated with each of extraction zones 46–50 are augmented by pumps 66 connected to draw fluid from the respective pans and apply the same to the respective showers 65 in a countercurrent manner. Preferably, the elevated temperature as described above is maintained throughout the system for the liquid phase. The mat 42, after initial draining at the zone 45, will have an increasing consistency so that the mat will exit the zone 50 at about 15% solids into a press section. This initial extraction is sugar rich and is sent by pump to tank 100 or directly to additional sugar processing.

The press section 70 employs a pressing belt 75 in which an upper carriage 76 carries rolls 77 and 78 running on the inside of the belt loop 80. These rolls co-act with the rolls 35 and 83 carried on a carriage 85 within the belt loop for the belt or wire 32. A mechanical pressing action is applied at the press section 70 through the belt 80 to force a substantial degree of the liquid phase out of the mat 42, and the liquid phase component is collected in a collector 90 where it may be directed by a pump 92 back to the second shower head 65. Alternatively, this liquid phase may be added to that extracted from zones 52 and 53 to downstream sugar processing stages 100. Accordingly, the fiber mass 95 which comes off the belt 32 couch roll 35 is almost entirely free of sugar content and is relatively dry having less than approximately 40% moisture content.

The countercurrent washing augmented by vacuum at each of the zones provides an efficient means by which the residual sugar content in the mat 42 is stripped and removed. It is preferred to add fresh water at the final filter stage of the countercurrent displacement extractor, such as at the final zone 50, and the pressate from the press section 76 added to the liquid extraction form zone 50 at pan 57, to be applied in countercurrent fashion to the immediately preceding zone 49, etc. A minimum amount of water is preferably added at the final stage so that the dilution factor at the next to the last stage, 49, should be approximately 1.0. (The dilution factor being a ratio of the amount of liquid added, by weight, to the weight of the 20 pulp at the stage, measured dry.) While six extraction stages plus a press section are shown in FIG. 3, it is obvious that more or less such extraction stages may be used, and an advantageous arrangement would include seven such extraction stages.

Figure 4:
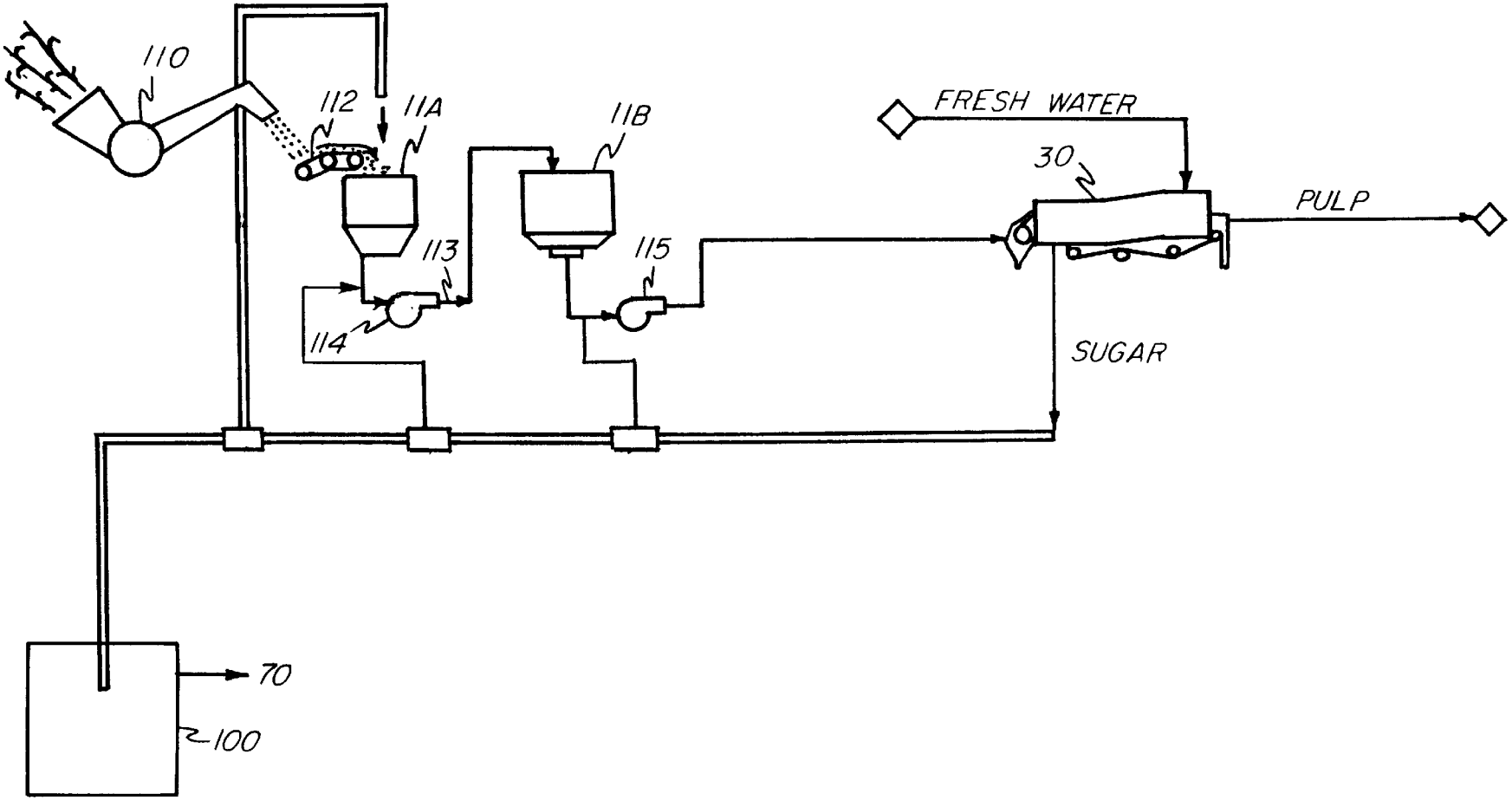
FIG. 4 is a schematic illustration of a preferred modified process employing tandem pulpers.

FIG. 4 shows schematically an arrangement in which a wood or brush type chipper 110 is fed with cane stocks (not shown), the output of which is carried by a conveyor 112 into the first of a pair of pulpers 11A and 11B which are connected in tandem. Pulped material is drawn through the extraction bedplate of first pulper 11A and provided in a line 11B to the tank of downstream or second pulper 11B. Preferably, the extraction plate of pulper 11A is provided with openings that are larger than those of the slots in the downstream pulper 11B and, for example, the openings in the bedplate of pulper 11A may be, for example, ¾ of an inch in diameter, while the openings in the bedplate for pulper 11B may be ⅜ of an inch in diameter. These figures may be modified as necessary to provide the desired degree of residence times within the pulper tank, usually in the order of about one-half hour each.

Depending upon the liquid content of the cane from the chipper 110, the canes may be pulped with the addition of only a small amount of liquid, if any. A 12% fiber content of the freshly cut canes is a typical figure, providing a pulp that has a 12% consistency of fiber content, which is readily pulpable by a hydrapulper. Liquid can be added in the form of water, or process liquid from the displacement extractor, as necessary to provide the proper consistency. Preferably, each of the pulpers 11A and 11B is operated at a relatively high consistency to permit the utilization of relatively smaller pulping tubs, thereby maximizing efficiency. A medium consistency pump 114 may receive process liquid to aid in the pumping of the cane fiber. Process liquid and/or water is added at pump 115 so that the headbox 40 receives the material for displacement extraction, as previously mentioned, at consistencies of between about 2%–4% solid component in the headbox 40.

Accordingly, the pulping effectively releases a major portion of the sugar content while leaving a non-pulpable fiber phase in the slurry with a dilute sugar concentration at the extractor. The liquid phase is substantially removed immediately using belt-type extraction with vacuum augmentation, while the remaining portion of the sugar content is subjected to countercurrent wash and extraction, with a final mechanical pressing stage for final extraction, leaving a relatively dry pressed bagasse component substantially free of its sugar content. The method of extraction including the hydrapulper and the countercurrent washer type extraction uses less energy than is required to process the same amount of cane through conventional roller presses.

The resulting bagasse from the press section of the belt type displacement extractor may be dried and packaged for use as a fiber in paper making, may be optionally dephithed, or may be returned as fuel for conventionally firing the steam boilers of the sugar mill.

While the methods herein described, and the forms of apparatus for carrying these methods into effect, constitute a preferred embodiment of this invention, it is to be understood that the invention is not limited to these precise forms of apparatus, and that changes may be made therein without departing from the scope of the invention, which is defined in the appended claims.

What is claimed is:

1. The process of extracting a sugar rich liquor from sugar cane comprising the steps of pulping the sugar cane in a water suspension in a tub type pulper with a rotating impeller to reduce the cane to a pulp and to fracture the sugar cells to release the sugar content into the liquid phase of said suspension, applying the pulped suspension from the pulper onto a moving foraminous belt, applying a differential air pressure across said belt to augment the extraction of liquid content from said pulp through said belt leaving a mat of pulp on said belt at a substantially higher consistency than said suspension, and subjecting said mat on said belt to repeated zones of separation in which liquid is applied to the mat from a region above the mat and extracting liquid in corresponding zone below the mat.

2. The process as recited in claim 1 in which said belt carries said mat through a plurality of extraction zones in which the liquid extracted from the last of said zones is applied to the preceding zones in a countercurrent manner.

3. The process of extracting sugar component from sugar cane comprising the steps of cutting the sugar cane into small pieces and applying said small pieces to at least one tank type pulper in which a rotor at the bottom of the pulper tank is positioned to run against a perforated bedplate, adding liquid or filtrate at an elevated temperature to said tank while operating said pulper to achieve a consistency of solid contents to total weight of about 8%–10%, continuing to operate said pulper rotor until at least about 70% of the sugar content of the cane is dissolved in the liquid phase, and draining said pulper through said bedplate and separating the liquid phase from the non-liquid phase.

4. The process as recited in claim 3 in which hot liquid or heat is added to achieve a pulp temperature about 50–75° C.

5. The process as recited in claim 3 in which the content of the pulped cane from the final pulper is diluted to a consistency of about 2%–4% and is applied to the headbox of a moving belt type extractor, onto an on-running end of a moving wire, including the further steps of applying a negative air pressure below the wire to augment the extraction of liquid content through the wire such that the consistency of the mat of pulp formed on the wire increases from about 2%–4% at the on-running end to about 15% at the off-running end while subjecting the mat to repeated zones of separation in which liquid is applied to the mat from a region above the mat and extracted from extraction zones below the mat, and sending the extracted sugar rich liquor for further processing.

6. The process as recited in claim 5 in which the mat on the wire is pressed between rollers at the off-running end of the wire for a final pressure extraction of liquid from the mat leaving a bagasse mat having a consistency of 40% or higher solids.

7. The process of extracting a liquid sugar component from sugar cane, comprising steps of: cutting the cane into small pieces and applying such small pieces to the tank of a first tank type pulper having a rotor at the bottom of the pulper tank positioned to operate against a perforated bedplate, adding liquid as necessary and pulping the contents of said first pulper tank and withdrawing the pulp contents through such bedplate, applying such contents to a second tank type pulp in a generally continuous manner, and extracting the pulp content from said second tank type pulper and diluting such extracted contents as necessary to a consistency of between about 2%–4%, applying said diluted contents to the upper surface of the belt of a moving countercurrent belt type displacement washer to form a mat of pulp on the washer belt and subjecting said mat to successive steps of liquid application to the upper surface of the mat and extraction of liquid through such belt to form a composite sugar rich extraction leaving said mat substantially free of available sugar content.

* * * * *